US007654845B2

(12) United States Patent
Buschle et al.

(10) Patent No.: US 7,654,845 B2
(45) Date of Patent: Feb. 2, 2010

(54) CONTACTING PLUG-AND-SOCKET CONNECTION WITH CONTACT FORCE INDEPENDENT OF CONTACT CARRIER THICKNESS

(75) Inventors: Hartmut Buschle, Fellbach (DE); Ulrich Schmatz, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 135 days.

(21) Appl. No.: 11/914,783

(22) PCT Filed: Nov. 29, 2006

(86) PCT No.: PCT/EP2006/069066

§ 371 (c)(1),
(2), (4) Date: Nov. 19, 2007

(87) PCT Pub. No.: WO2007/071532

PCT Pub. Date: Jun. 28, 2007

(65) Prior Publication Data

US 2008/0188130 A1 Aug. 7, 2008

(30) Foreign Application Priority Data

Dec. 20, 2005 (DE) ..... 10 2005 063 239

(51) Int. Cl.
*H01R 13/62* (2006.01)
*H01R 13/15* (2006.01)

(52) U.S. Cl. ..... 439/260

(58) Field of Classification Search ..... 439/260, 439/62, 65, 67, 632

See application file for complete search history.

(56) References Cited

U.S. PATENT DOCUMENTS

| | | | | |
|---|---|---|---|---|
| 3,478,301 | A | 11/1969 | Conrad et al. | |
| 3,594,699 | A | 7/1971 | Jayne et al. | |
| 3,980,376 | A * | 9/1976 | Rosen | 439/327 |
| 4,894,022 | A | 1/1990 | Guckenheimer | |
| 5,564,931 | A * | 10/1996 | Fabian et al. | 439/62 |
| 5,573,415 | A | 11/1996 | Fujita et al. | |
| 5,679,018 | A * | 10/1997 | Lopata et al. | 439/260 |
| 5,913,699 | A * | 6/1999 | Zielke | 439/632 |
| 6,036,519 | A * | 3/2000 | Lopata et al. | 439/260 |
| 6,238,226 | B1 | 5/2001 | Schepp et al. | |
| 6,494,781 | B2 | 12/2002 | Fujita et al. | |

FOREIGN PATENT DOCUMENTS

| | | |
|---|---|---|
| DE | 197 09 796 | 9/1998 |
| DE | 101 57 988 | 8/2002 |
| EP | 0 653 818 | 5/1995 |
| EP | 1 009 068 | 6/2000 |

* cited by examiner

*Primary Examiner*—Chandrika Prasad
(74) *Attorney, Agent, or Firm*—Michael J. Striker

(57) ABSTRACT

Disclosed is a contacting connector (53) comprising a contacting plug (25) and a contacting socket (97) which is assigned, preferably joined in a defined position, to a contact carrier (17), particularly a printed board (16). The contacting plug (25) is fitted with at least one contact element (58) while the contact carrier (17) is provided with at least one contact surface (127), preferably a land (126) or a strip conductor. A receiving direction (a) that corresponds to a plug-in direction is defined between the contacting plug (25) and the contact carrier (17) while the contact element (58) lies on the contact carrier (17) with a certain contact force ($F_K$). The inventive contacting connector (53) is characterized in that the contact force ($F_K$) is independent of a force (F) acting between the contacting socket (97) and the contact carrier (17).

12 Claims, 6 Drawing Sheets

Figure 1:
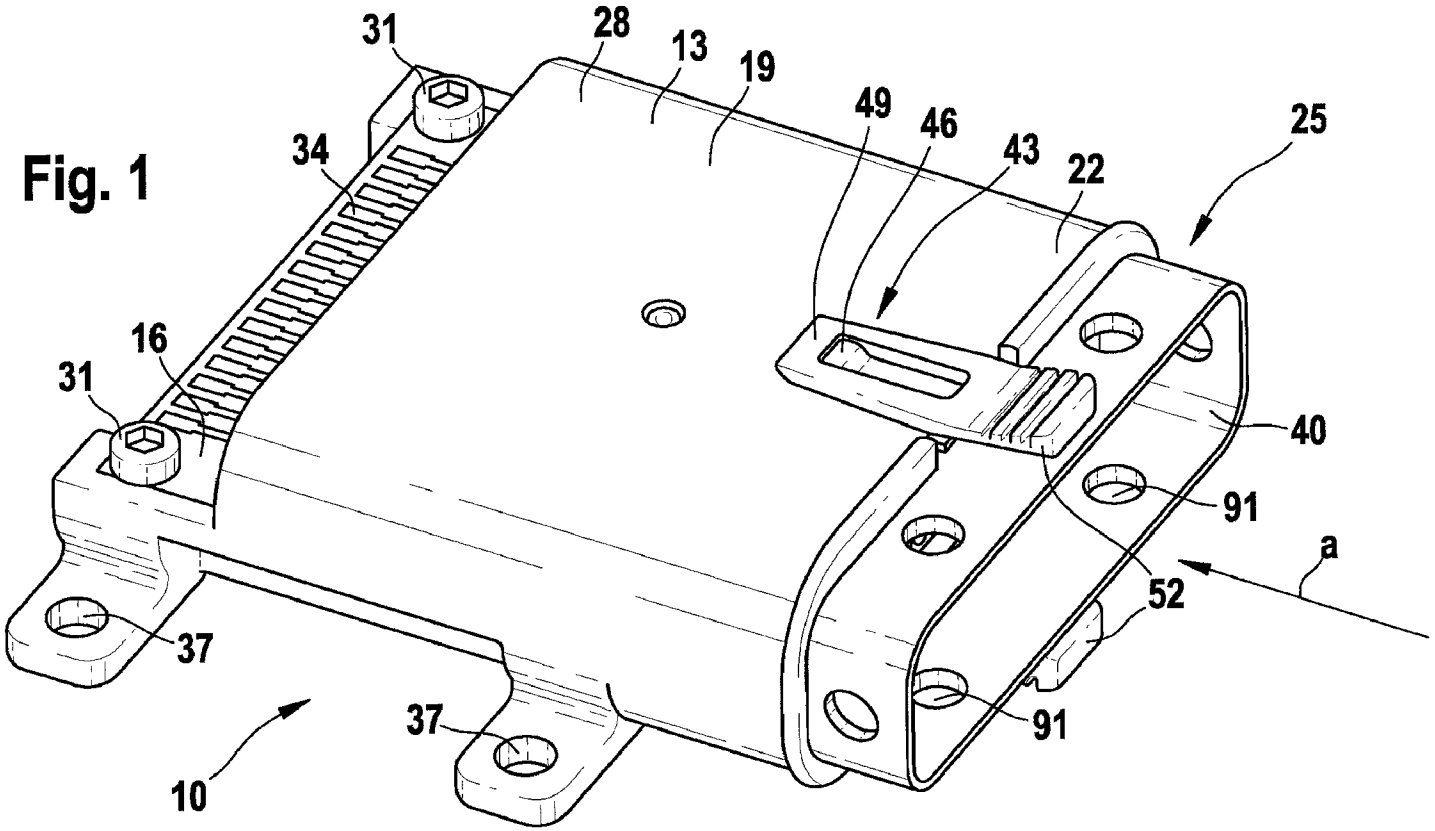

CONTACTING PLUG-AND-SOCKET CONNECTION WITH CONTACT FORCE INDEPENDENT OF CONTACT CARRIER THICKNESS

RELATED ART

The present invention relates to a contacting plug-and socket connection composed of a contacting plug and a contacting socket, which are generally known. Plug-and-socket connections, of the type made known in DE 197 09 796 A1, for example, have the disadvantage that the contact elements of the contacting plug and the contacting socket are stressed with shear forces during the joining and/or plug-in procedure. It is disadvantageous that strong forces act between the contacting elements, which may cause deformation of rather delicate contact elements made of metal plate. As a result of repeated attachment and disconnection, the deformation may result in permanent damage to the plug device, thereby impairing its function. The present invention is directed to a contacting plug-and-socket connection as described in EP 1009068 A1.

There are electrical devices, e.g., control devices, that do not include plug connectors. With these devices, lands located on the component side or the counter-component side are contacted directly. It has been found that, when defective printed-circuit boards of this type are replaced with intact printed-circuit boards, it is not always possible to reliably contact the lands. This could be the case, e.g., when the printed-circuit boards have different thicknesses.

ADVANTAGES OF THE INVENTION

The inventive contacting plug-and-socket connection—that is composed of a contacting plug and a contacting socket assigned to a contact carrier, i.e., a printed-circuit board in particular, and being preferably joined therewith in a defined position, the contacting plug including at least one contact element, and the contact carrier including at least one contact surface, preferably a land or a printed conductor; a receiving direction between the contacting plug and the contact carrier corresponding to a plug-in direction is defined, and the contact element lying on the contact carrier with a contact force that is independent of a force acting between the contacting socket and the contact carrier—has the advantage that different thicknesses of printed-circuit boards are tolerated, while consistently strong contact forces are nonetheless ensured. The reliability of the function is therefore ensured, even when different printed-circuit boards are used. The same applies when a contact holder defines a position of a contact element relative to the contact carrier, so that the contact force is independent of the material thickness of the contact carrier.

When a spring element applies a force between the contacting socket and the contact carrier, the contact force is independent of the force exerted by the spring element.

The inventive contacting plug-and-socket connection composed of a contacting plug and a contacting socket, which is designed to receive the contacting plug in a receiving direction, the contacting plug being designed with at least one contact holder and at least one contact element, and the latter being held by the first contact holder, has the advantage that, given that the first contact holder includes a push-in guidance element that, when the contacting plug is pushed into the contacting socket, interacts with a counter-push-in element to allow a motion of the first contact holder in a direction that is essentially perpendicular to the receiving direction, a plug-and-socket connection is made possible that is largely or entirely free of shear forces. This means that no forces or hardly any forces act on the contact elements in the receiving direction while the contacting plug is pushed into the contacting socket. Damage to the contact elements caused during the plug-in procedure may therefore be at least largely ruled out, thereby enabling the plug-and-socket connection to be disconnected numerous times without affecting the quality of the connection and, particularly preferably, of the electrical contacting. This design also has the advantage that the contacting elements may be designed to be relatively lightweight and composed of a minimum of material.

Advantageous refinements of the contacting plug-and-socket connection according to the main claim are made possible by the measures described in the subclaims. According to a further embodiment of the present invention, it is provided that the contacting plug includes a second contact holder with at least a second contact element, the second contact holder including a push-in guidance element that, when the contacting plug is pushed into the contacting socket, interacts with a counter-push-in guidance element to allow a motion of the contact holder in a direction that is essentially perpendicular to the receiving direction. This type of plug design enables counter-contacts—which are connected with the contacting socket—to be contacted simultaneously in a second plane.

If the additional motions of the contact holder in the contacting socket of the first contact holder and the second contact holder are opposed, motion control of this type makes it possible, e.g., to contact a printed-circuit board—which is provided with counter-contacts, e.g., lands, on both sides—with the contacting plug on both sides simultaneously. This has the advantage that a particularly large number of contact connections may be established simultaneously and in a small space.

According to a further embodiment of the present invention, it is provided that the first contact holder and, possibly, the second contact holder includes a pull-out element that, when the contacting plug is pulled out of the contacting socket, interacts with a counter-pull-out guidance element to allow a motion of the contact holder(s) in a direction that is essentially perpendicular to the receiving direction. As a result, no shear forces, or only slight shear forces occur between the contact elements when the contacting plug is pulled out of the contacting socket. This measure also serves to extend the service life of the contacts.

To enable a good spacial assignment of a first contact holder relative to the second contact holder, which is required for insertion in particular, the two contact holders are connected by a hinge, which is preferably designed as a film hinge, i.e., as a single-piece connection between the two contact holders.

To ensure that a good electrical contact may be established between the contacting element and the counter-contacting element by the contacting socket, it is provided that a spring element is located on the side of the contact holder facing away from the contact element(s), the spring element applying a spring force to the contact holder that acts between the contacting socket and the contact holder. When the contacting socket includes a printed-circuit board as the element to be contacted, this may enable the contact holder to lie flush overall—via a reference surface—on the generally flat printed-circuit board. As a result, the contacting element may be held in a position that is favorable for the printed-circuit board, and a contact force may be limited. The plug-and-socket connection becomes independent of the tolerance of the printed-circuit board. The contact force may be held largely constant. This is important mainly when making replacements "in the field", when replacing printed-circuit boards having different material thicknesses.

To prevent foreign objects from entering this plug-and-socket connection, it is provided that a sealing element is installed between an assembly-facilitating housing and the contacting plug-and-socket connection on the contact plug side. In an end position of insertion, the sealing element seals a seam between the contacting socket and the assembly-facilitating housing.

A form-fit seat of the at least one contact holder in the assembly-facilitating housing ensures that the contact holder and assembly-facilitating housing are in good positions relative to each other, which is very important for insertion. When this form-fit connection is established using a snap-in connection, this is a particularly cost-favorable and functionally reliable measure.

It is also provided that the contacting socket is part of a control device housing. This means that the contacting socket is connected as a single piece with the control device housing and/or with a part of the possibly multicomponent control device housing, thereby making it possible to avoid the need for additional seams—which would have to be sealed—and the typical problems associated therewith.

DRAWING

An exemplary embodiment of an inventive contacting plug-and-socket connection is shown in the drawing.

Figure 2:
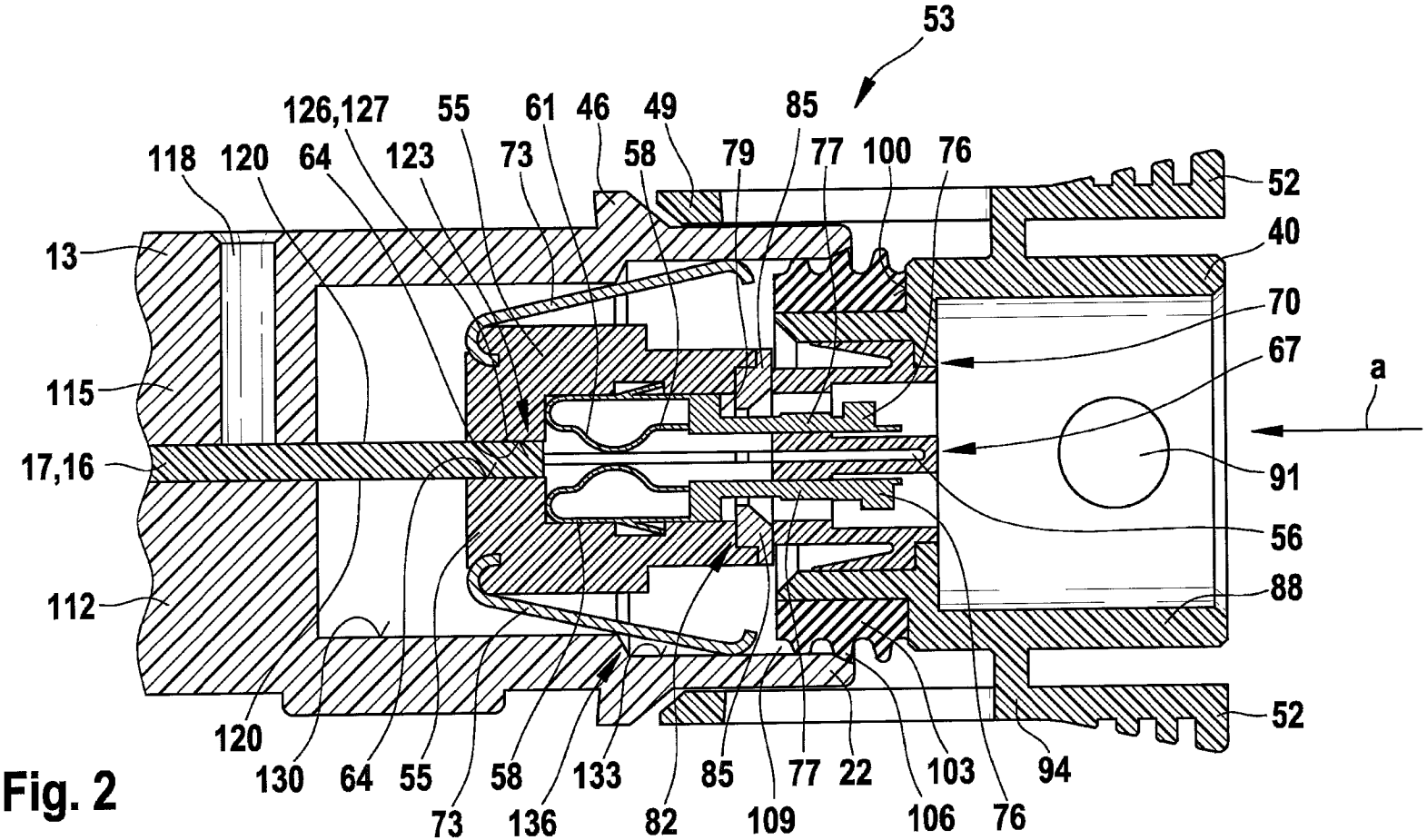
Figure 3:
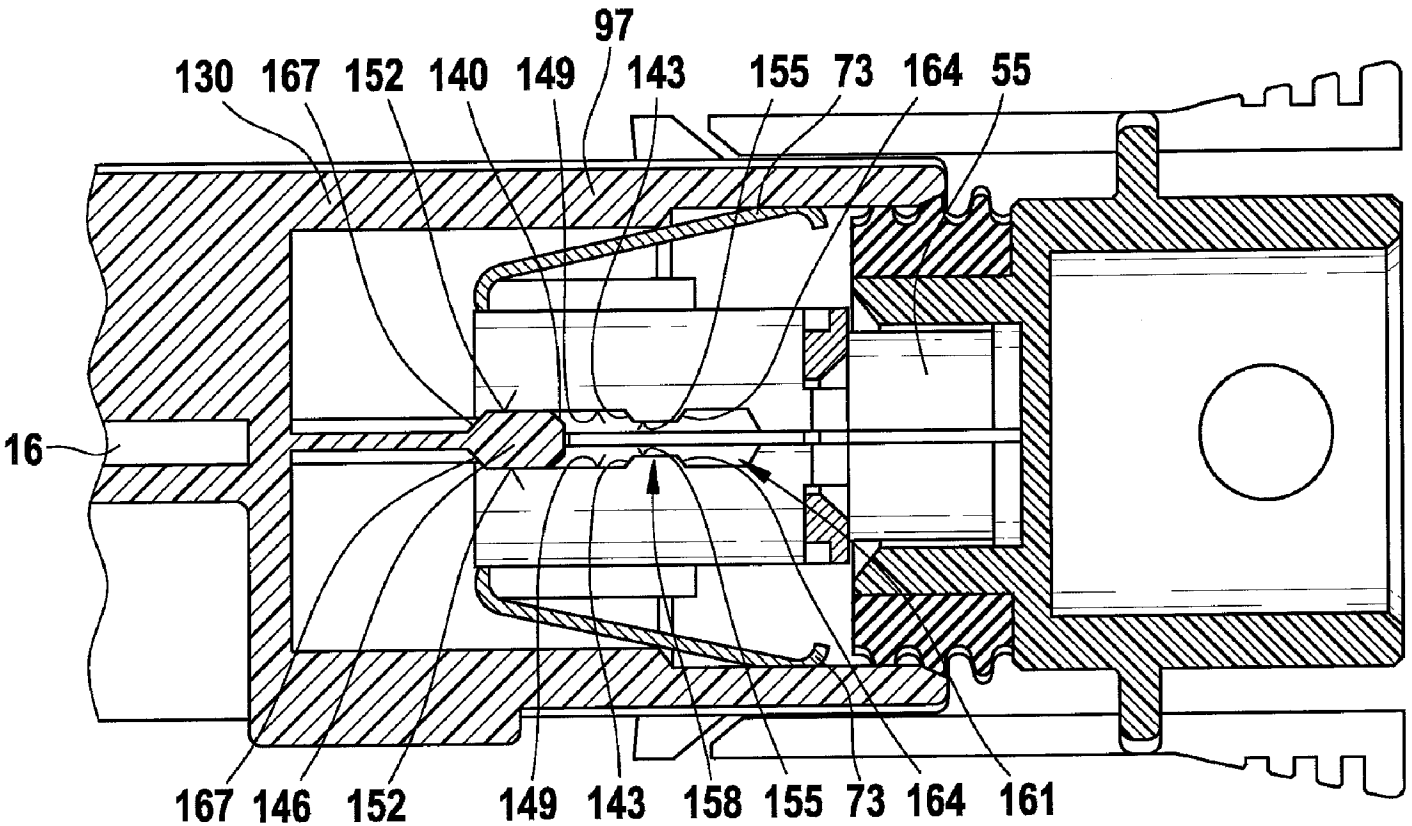
Figure 4:
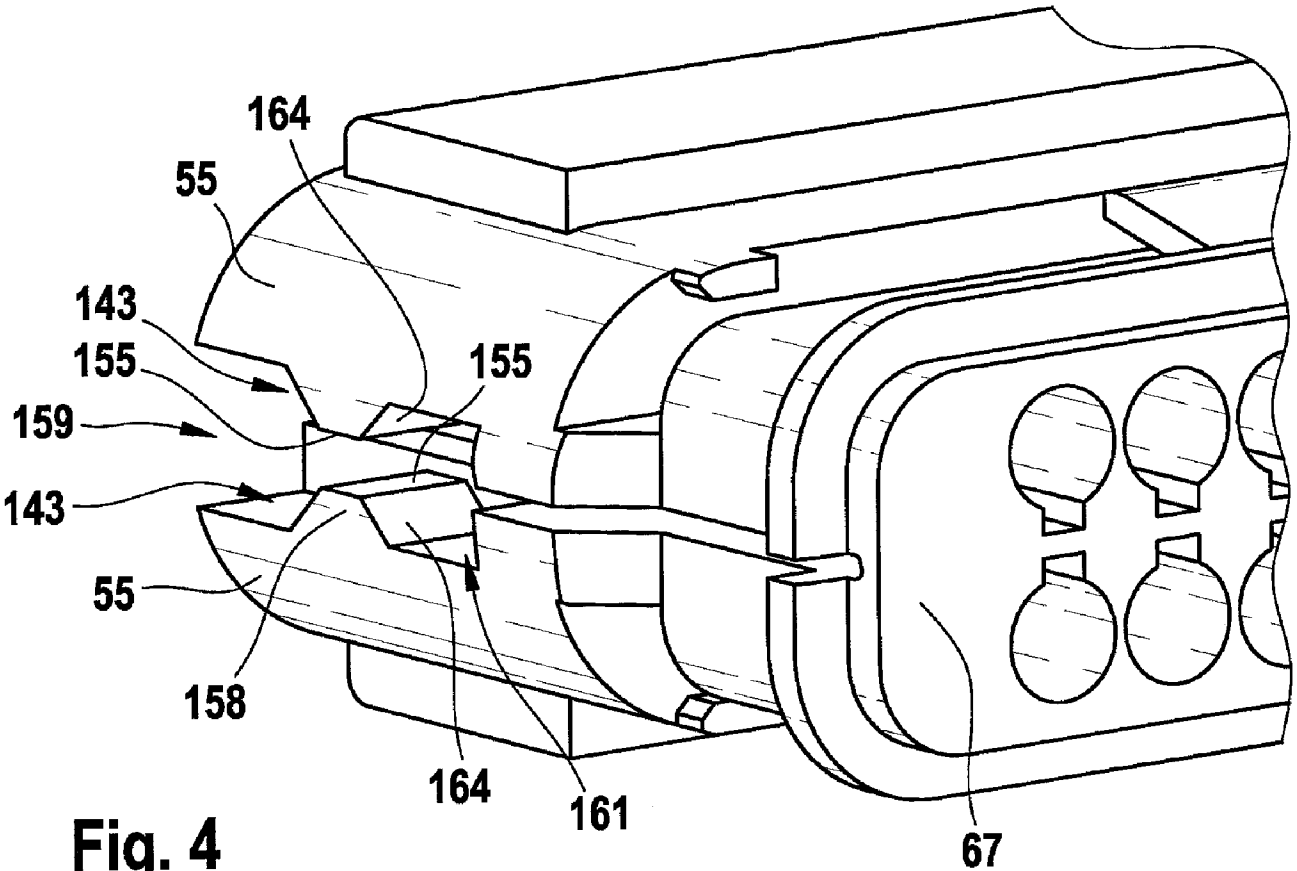
Figure 5:
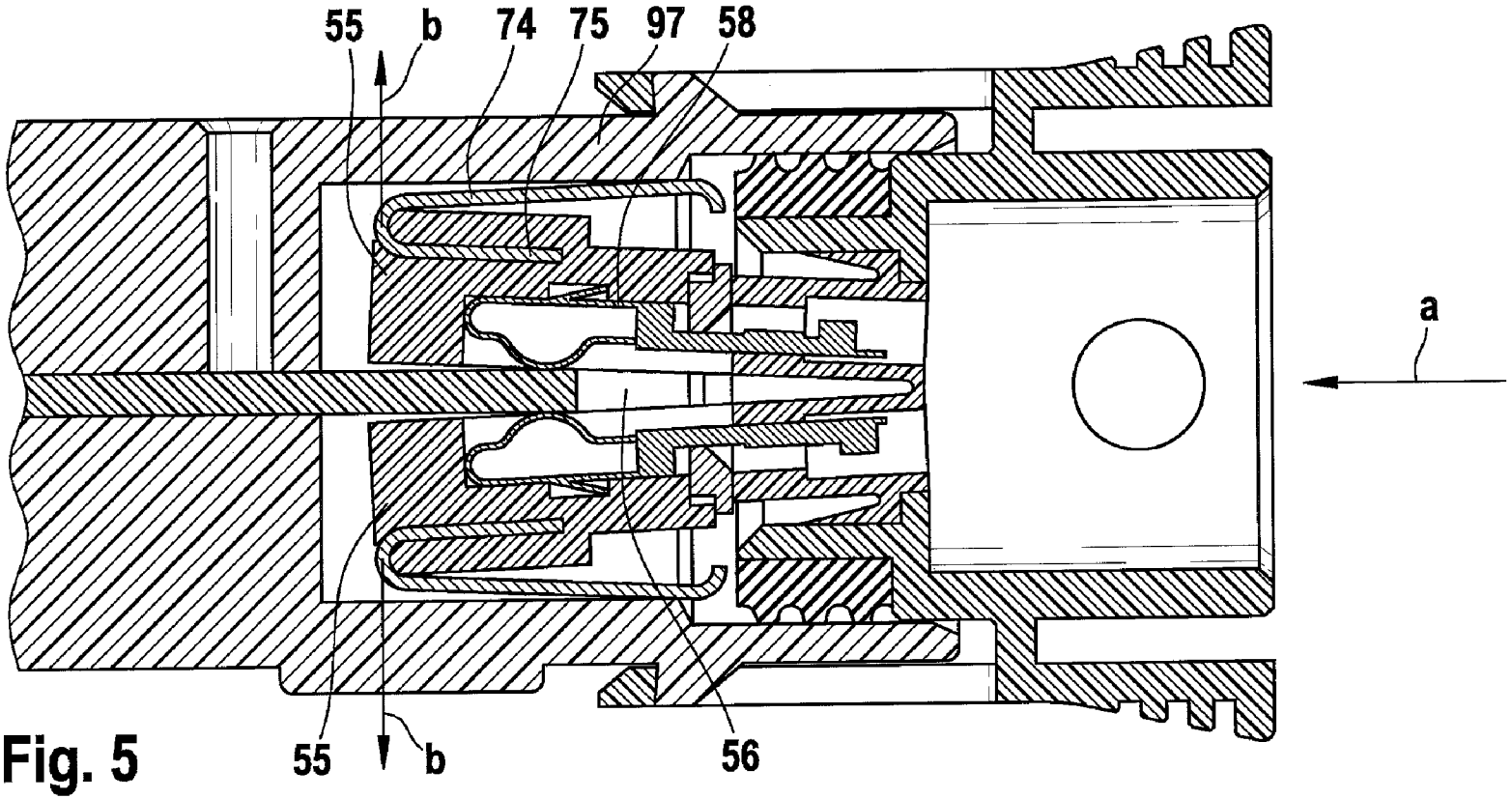
Figure 6:
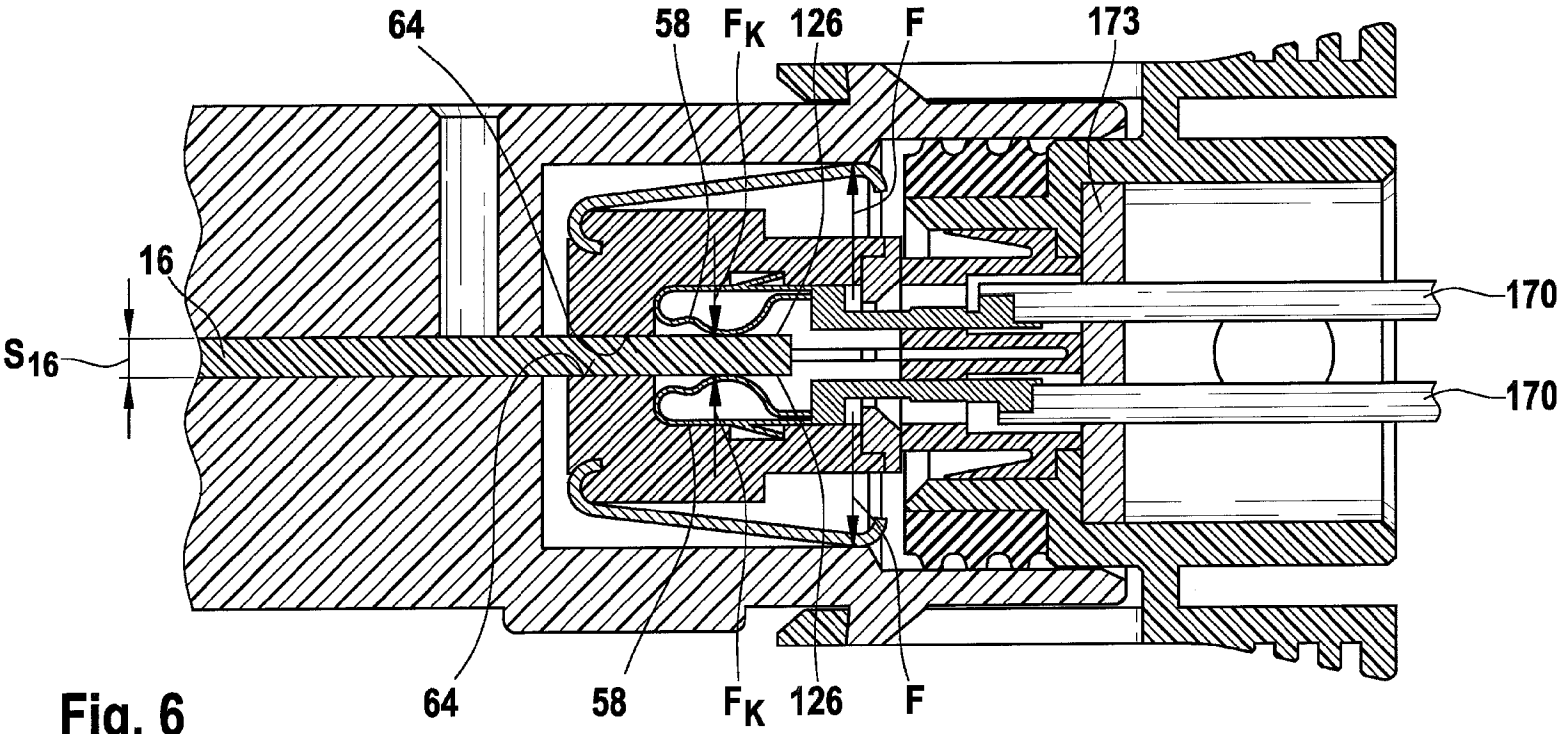

FIG. 1 shows a control device with a contacting socket formed thereon as one piece, and with an inserted contacting plug, FIG. 2 shows a longitudinal sectional view of the connecting plug-and-socket connection after initiation of insertion of the contacting plug into the contacting socket, but before the contact has been established, FIG. 3 shows a further longitudinal sectional view of the connecting plug-and-socket connection in the position shown in FIG. 2. The longitudinal sectional view in this figure intersects the contacting socket outside of the contact holder, i.e., between the contacting socket and the contacting plug, thereby resulting in a side view of the side edge of the printed-circuit board, FIG. 4 shows a first and second contact holder, which is connected as a single piece using a film hinge, FIG. 5 shows the contacting plug before the end position of insertion in the socket has been reached, FIG. 6 shows the connecting plug-and-socket connection in the end position of insertion of the contacting plug.

DESCRIPTION

FIG. 1 shows a control device 10, which, via a control device housing 13, encloses an electronic control and/or circuit located on a printed-circuit board 16, which is referred to in general as a contact carrier 17. Control device housing 13 has a nearly tubular design and therefore includes a jacket 19 with an opening on a first axial end 22 that has already been closed in this case via an inserted contacting plug 25. In this case, printed-circuit board 16 mentioned above extends out of the other end, i.e., axial end 28 diametrically opposed to first axial end 22. At this end, printed-circuit board 16 is attached to control device housing 13 via two fastening elements 31. Lands 34 are shown between the two fastening elements 31, which are designed as screws in this case, and which are part of a printed-circuit board structure on printed-circuit board 16. Lands 34 serve the purpose of being electrically connected with further, not-shown contact elements. Control device housing 13 also includes a total of four fastening segments 37, only two of which are shown in this example. Fastening segments 37 include holes and serve to fasten control device housing 13 to a holder. As part of contacting plug 25 mentioned above, an assembly-facilitating housing 40 is shown in FIG. 1, and it is described in greater deal with reference to FIG. 2. Assembly-facilitating housing 40 serves to hold a contacting plug that is already located in control device housing 13, as shown in FIG. 1. A locking mechanism 43 is provided for this purpose. Locking mechanism 43 is composed of a snap-in wedge 46 located on control device housing 13, snap-in wedge 46 being latched around the rear by a snap-in hook 49 located and/or fastened on assembly-facilitating housing 40 such that assembly-facilitating housing 40 is captively held on control device housing 13. Snap-in hook 49 includes a pusher handle 52 on its end pointing away from control device housing 13, via which locking mechanism 43 may be easily released. A cabling of contacting plug 25 that is typically present is not shown here.

A contacting plug-and-socket connection 53 is shown in FIG. 2. FIG. 2 shows a partial sectional view of control device housing 13 and contacting plug 25. In contrast to FIG. 1, contacting plug 25 and assembly-facilitating housing 40 have not yet been inserted into control device housing 13 so far that snap-in hook 49 has engaged behind snap-in wedge 46. Assembly-faciliating housing 40 includes—as part of contacting plug 25—a first contact holder 55 and a second contact holder 55. Contact holders 55 are positioned with mirror symmetry relative to each other, and they are separated by a gap 56. As the name says, each of the two contact holders 55 includes at least one contacting element 58. Contacting elements 58 serve to electrically connect not-shown cables guided through assembly-facilitating housing 40 with printed-circuit board 16. Contacting elements 58 will be discussed in detail below. Contacting elements 58 are held stationary in contact holder 55, and they each include a U-shaped section 61, which, due to its design, is designed to be resilient to a normal force or contact force $F_K$ that acts thereon and is exerted by the printed-circuit board. U-shaped sections 61 of the two diametrically opposed contacting elements 58 of the two diametrically opposed contact holders 55 face each other. Contacting elements 58 accommodate printed-circuit board 16 between them, which will be described below. Each contact holder 55 has a contact surface 64, the two contact surfaces 64 facing each other and subsequently serving to enable an essentially constant contact pressure between U-shaped section 61 and printed-circuit board 16 by the fact that contact surfaces 64 come to rest on printed-circuit board 16, in order to adjust a distance between parts of contact elements 58 and the surface of the printed-circuit board. Contact holder 55 defines the position of a contact element 58 relative to contact carrier 17. Contact force $F_K$ is therefore independent of a material thickness $S_{16}$ of contact carrier 17. The adjusted distance in this case is the distance between the back side of contacting element 58 facing away from printed-circuit board 16 and the surface of printed-circuit board 16. The back side of contacting element 58 is the point at which contact holder 55 introduces force $F_K$ into contacting element 58.

In this exemplary embodiment, the two contact holders 55 are connected with each other as a single piece by that fact that they are connected with each other as a single piece at their common end facing away from printed-circuit board 16 and U-shaped sections 61. In this case, the single-pieced connection is formed by a hinge 67, which is designed as a film hinge in this case. Contact holders 55 are fastened to assembly-facilitating housing 40 in a form-fit manner using a snap-in connection 70. At least one spring element 73 is located on the side of contact holder 55 facing away from contact element 58. Spring element 73 is shown in sections in FIG. 2.

Contact element 58 includes essentially three sections along its length: The first section is U-shaped section 61 mentioned above. A second section, which faces away from U-shaped section 61, serves at the other end of contact element 58 to fasten a cable mentioned above, but which is not shown in FIG. 2 and is designed as a crimp connection 76. A middle section 77 is located between U-shaped section 61 and crimp connection 76. Middle section 77 is limited by a stop 79 in the direction toward U-shaped section 61. In interaction with a locking clamp 82—two legs 85 of which are shown in FIG. 2—stop 79 prevents contacting elements 58 from being pulled out of contact holder 55 when excessive pulling forces act on crimp connection 76.

Assembly-faciliating housing 40 includes several functional housing sections. A first outer sleeve section 88 facing away from contact holders 55 serves on its outer circumference to enable, e.g., a sealing cuff in this case, to be installed via a form-fit connection using holes 91 shown here. Outer sleeve section 88 is followed—in the direction toward contact holders 55—by an outer stop 94, which, in interaction with control housing device 13—which is designed as a contacting socket 97—determines a maximum receiving depth of assembly-facilitating housing 40 and, therefore, contact holder 55 in contacting socket 97. Outer stop 94 serves, with short sections, as a swivel hinge for snap-in hook 49 or pusher handles 52. Outer stop 94 is followed by an axial stop 100, which is a stop for a sealing element 103. In Example 3, this sealing element serves, on sealing lips 106 formed in its outer circumference, to seal a seam 109 between contacting socket 97 and assembly-facilitating housing 40. Sealing element 103 is seated on an outer circumference, which is smaller than outer sleeve section 88. Sealing element 103 is located in nearly the same axial position as snap-in connection 70 mentioned above.

Contacting socket 97 is the counterpiece to contacting plug 25. Printed-circuit board 16 is located nearly in the center in this contacting socket 97. Printed-circuit board 16 is centered between two supports 112 and 115. One support 115 is designed as a sleeve in this case, which includes a through-hole 118 that ends on the outer surface of contacting socket 97. Through-hole 118 may serve, e.g., to accommodate a screw, by way of which printed-circuit board 16 may be clamped between columns 112 and 115. Printed-circuit board 16 includes printed conductors 120 on its two surfaces. At their end 123 that is directed toward the opening of contacting socket 97 that accommodates contact plug 25, printed conductors 120 end in lands 126 described above. Lands 126, which are located on both sides of printed-circuit board 16, serve as a contact surface 127 for contacting elements 58.

Socket 97 includes a total of three inner sections, which will be described below. First inner section 130 serves to enclose and protect the contact point between lands 126 and contacting elements 58. This first inner section is followed—in the direction of axial end 22—by a second inner section 133, which is designed larger in terms of its inner dimensions than first inner section 130. This second inner section serves as a countersurface for sealing lips 106 of sealing element 103 and, therefore, as a sealing surface. Third inner section 136 is formed by a step 136, which connects first inner section 130 and second inner section 133 with each other. This step 136 serves to generate a pressure force or force F, which acts on spring elements 73 from the outside, in order to subsequently press the two contact holders 55 onto printed-circuit board 16. Spring element 73 produces force F between contacting socket 97 and contact carrier 17.

A somewhat offset longitudinal sectional view of plug-and-socket connection 53 is shown in FIG. 3, in the same position as in FIG. 2. The cutting plane is located in seam 109, but in a position at a maximum distance away from pusher handles 62. This sectional view reveals a side view of certain functional elements of this plug-and-socket connection. On both sides of printed-circuit board 16, for example, socket 97 includes a counter-push-in guidance element 140, which interacts with a push-in guidance element 143. Push-in guidance element 143 is integrally formed on contact holder 55. Counter-push-in guidance element 140 is part of the surface of a wedge 146, on which contact holder 55 guides when inserted into socket 97 with a sliding surface 149. Contact holder 1o 55 is pressed by spring element 73 onto counter-sliding surface 152. When contact holder 55 is now slid further into socket 97, a position is reached at which push-in guidance element 143 bears against counter-push-in guidance element 140. When contact holder 55 is pushed in further, the wedge effect of guidance elements 143 and 140 causes contact holder 55 to be pushed away from wedge 146, thereby displacing it in the direction toward first inner section 130. When contact holder 55 is slid in further, a second sliding surface 155 is pushed over counter-sliding surface 152 so far that wedge 146—after it has passed a constriction point 158 formed by second sliding surfaces 155—reaches its end position in an end recess 161. Printed-circuit board 16 is accommodated in gap 56 between the two contact holders 55.

FIG. 4 shows a spacial view of two interconnected contact holders 55, which were described above with reference to FIG. 2. In the plane in which contact holders 55 are diametrically opposed to each other, contact holders 55 form a channel 159 for wedge 146, which spreads the two contact holders 55 apart via push-in guidance elements 143. Wedge 146 ultimately reaches end recess 161. The procedure for pulling out contact holder 55 takes place in reverse. Two pull-out guidance elements 164 act on counter-pull-out guidance elements 167 on wedge 146, FIG. 3, such that, when contact holders 55 are pulled out of socket 97, contact holders 55 are spread apart once more, thereby allowing decoupling to take place. A channel 159 of this type is preferably provided on either side of contact holder 55.

FIG. 5 shows the position of contacting plug 25 at the point at which a push-in guidance element 143 just presses against a counter-push-in element 140, so that contact holders 55 therefore experience a second component of motion. The first component of motion is the receiving direction, as indicated in FIG. 5. This direction is the direction of insertion, as also indicated as "a" in FIG. 2 and FIG. 1. Via push-in guidance elements 143 and counter-push-in guidance elements 140, a second direction of motion b is forced on contact element 55, which is essentially perpendicular to receiving direction a.

A contacting plug-and-socket connection 53 composed of a contacting plug 25 and a contacting socket 97 is therefore provided, which is designed to receive contacting plug 10 25 in a receiving direction a, contacting plug 25 being provided with at least one first contact holder 55 and at least one contact element 58, the latter being held by first contact holder 55.

The subject is characterized by the fact that first contact holder 55 includes a push-in guidance element 143 that, when contacting plug 97 is pushed into contacting socket 97, interacts with a counter-push-in guidance element 140 to allow an additional motion b of first contact holder 55 in a direction that is essentially perpendicular to receiving direction a.

It is also provided that contact holder 55 is lockable in a fixed position directly or indirectly with a counter-contact holder. As described above, the contact holder is lockable in a fixed position directly, i.e., via assembly-facilitating housing 40, with a counter-contact holder, which has been described in this case as control device housing 13 and contacting socket 97. It is also feasible for contact holder 55 to be fastened, e.g., directly to a printed-circuit board 16. Printed-circuit board 16, with its lands 126, is a counter-contact holder.

The exemplary embodiment described so far includes two contact holders 55, which are positioned relative to each other with mirror symmetry. The contacting plug-and-socket connection shown here may be used in other ways in addition to this symmetrical manner. As an alternative, it may be provided that the contacting plug is designed only with an upper—as shown in FIG. 2—half of the variant of contacting plug 25 shown there. This would mean that the lower portion of plug 25 starting at hinge 67 would not be present, but if so, only such that lower contact holder 55 with contacting elements 58, spring elements 73 would not be present. In this case, only an upper contact holder 55, for example, would perform the motions on a wedge 146—only half of which may be present. As an alternative, it is provided that contacting plug 25 includes a second contact holder 55 with at least a second contact element 58, second contact holder 55 including a push-in guidance element 143 that, when contacting plug 25 is pushed into contacting socket 97, interacts with a counter-push-in guidance element 140 to allow an additional motion b of contact holder 55 in a direction that is essentially perpendicular to receiving direction a. When the two contact holders 55 are positioned with mirror symmetry relative to each other (FIG. 2), the additional motions of first contact holder 55 and second contact holder 55 are opposed to each other.

It is provided that first contact holder 55 and, possibly, second contact holder 55, each includes a pull-out guidance element 164 that, when contacting plug 97 is pulled out of contacting socket 97, interacts with a counter-pull-out guidance element 167 to allow an additional motion b of first contact holder(s) 55 in a direction that is essentially perpendicular to receiving direction a. As described above, it is provided that two contact holders 55 are connected via a hinge 67, which is preferably designed as a film hinge.

A spring element 73 is coated on the side of contact holder 55 facing away from contact element 58. Spring element 73 is designed essentially as a "V" or a "U", and includes two legs 74 and 75. Leg 75 located closer to the printed-circuit board serves to support and fix spring element 73 in position in contact holder 55. Leg 74, due to its position between contact holder 55 and contacting socket 97, induces a pressure force between contacting element 58 and printed-circuit board 16 and its lands 126.

FIG. 6 shows contacting plug 25 in contacting socket 97 in the end position of insertion. In this end position of insertion, at least one contact element 58 contacts a land 126 of printed-circuit board 16. At least one contact holder 55 lies flush via its contact surface 64 on printed-circuit board 16. As mentioned above, this design—independently of the material thickness of printed-circuit board 16—ensures that a nearly constant contact force $F_K$ is applied by contact element 58 to land 126. Contact force $F_K$ is independent of a force F, which acts between contacting plug 25 and contact carrier 17.

The subject presented here is a direct plug-and-socket connection. That is, a plug connector is not provided, and a cable assembly or contacting plug 25 is contacted directly on the printed-circuit board. Via the insertion motion or insertion procedure, contact elements 58 are moved via superposed second additional motion b such that contact elements 58 come to rest on countercontacts with minimal shear force. During the insertion procedure, contacting element 58 is not contacted with printed-circuit board 16 or its lands 126 until very late, thereby protecting them from potential damage. Any oxidation layers that may be present on the contact surfaces may be broken through via the relative, sliding motion between lands 126 and contact elements 58 that take place during the insertion procedure. Printed-circuit boards typically include relatively large fluctuations in terms of width and thickness. As such, the subject described here need not compensate for the tolerances of printed-circuit board 16. This takes place via outer spring elements 73, which always bring contact holder 55 into the defined end position defined by the surface of the printed-circuit board and/or the shape of printed-circuit board 16.

The subject described here may be sealed, e.g., between the cables and the plastic housing with the aid of elastomers or with gel. As such, as shown in FIG. 6, for example, the inner region of sleeve section 88 may be sealed off from cables 170 guided through, using a perforated seal 173. Instead of a perforated seal 173, a casting may be applied as a sealing mass at this point. Via the preload of spring elements 73 at step 136, contact holders 55 slid toward each other along pull-out guidance elements.

What is claimed is:

1. A contacting plug-and-socket connection (53) comprising:

a contacting plug (25); and a contacting socket (97) assigned to a contact carrier (17), the contacting plug (25) including at least one contact element (58), and the contact carrier (17) including at least one contact surface (127), a receiving direction (a) defined between the contacting plug (25) and the contact carrier (17) corresponding to a plug-in direction, and the contacting plug (25) including at least one first contact holder (55) that holds the at least one contact element (58) and defines a position of the contact element (58) relative to the contact carrier (17), the first contact holder (55) including at least one push-in guidance element (143) that, when the contacting plug (25) is pushed into the contacting socket (97), interacts with a counter-push-in guidance element (140) to allow an additional motion of the first contact holder (55) in a transverse direction (b) that is essentially perpendicular to the receiving direction (a), and when the contacting plug (25) is plugged in the contacting socket (97), the contact element (58) lies on the contact carrier (17) with a certain contact force ($F_K$), wherein when the contacting plug (25) is not plugged in the contacting socket (97), a U-shaped section (61) of the contact element (58) protrudes over a contact surface (64) of the first contact holder (55) in the traverse direction (b), and when the contacting plug (25) is plugged in the contacting socket (97), the contact surface (64) lies flush on the contact carrier (17), whereby the contact force ($F_K$) is independent of a force (F) acting between the contacting plug 25 and the contact carrier (17), and is independent of a material thickness ($S_{16}$) of the contact carrier (17).

2. The contacting plug-and-socket connection (53) as recited in claim 1, wherein the contact carrier (17) is a printed-circuit board (16), and the contact surface (127) is a land (126) or a printed conductor.

3. The contacting plug-and-socket connection (53) as recited in claim 1, wherein a spring element (73) provides the force (F) between the contacting socket (97) and the contact carrier (17).

4. The contacting plug-and-socket connection as recited in claim 1, wherein the contacting plug (25) includes a second contact holder (55) with at least a second contact element (58), the second contact holder (55) including the push-in guidance element (143) that, when the contacting plug (25) is pushed into the contacting socket (97), interacts with the counter-push-in guidance element (140) to allow an additional motion of the second contact holder (55) in the transverse direction (b).

5. The contacting plug-and-socket connection as recited in claim 4, wherein the additional motions of the first contact holder (55) and the second contact holder (55) are opposed to each other.

6. The contacting plug-and-socket connection as recited in claim 4, wherein the first contact holder (55) and the second contact holder (55) are connected via a hinge (67).

7. The contacting plug-and-socket connection as recited in claim 1, wherein the first contact holder (55) includes a pull-out guidance element (164) that, when the contacting plug (25) is pulled out of the contacting socket (97), interacts with a counter-pull-out guidance element (167) to allow a motion of the first contact holder (55) in the transverse direction (b).

8. The contacting plug-and-socket connection as recited in claim 1, wherein a spring element (73) is located on the side of the first contact holder (55) that is opposite to the contact element (58).

9. The contacting plug-and-socket connection as recited in claim 1, wherein the contacting socket (97) is part of a control device housing (13).

10. The contacting plug-and-socket connection as recited in claim 1, wherein the at least one first contact holder (55) is seated in an assembly-facilitating housing (40) in a form-fit manner.

11. The contacting plug-and-socket connection as recited in claim 10, wherein a sealing element (103) is fastened to the assembly-facilitating housing (40), which, in the end position of insertion, seals a seam (109) between the contacting socket (97) and the assembly-facilitating housing (40).

12. The contacting plug-and-socket connection as recited in claim 1, wherein the first contact holder (55) is lockable in a fixed position directly or indirectly with a counter-contact holder (16, 97, 13).

* * * * *